US006420951B1

(12) United States Patent
Koppmann et al.

(10) Patent No.: US 6,420,951 B1
(45) **Date of Patent: *Jul. 16, 2002**

(54) SINTERED ARMATURE

(75) Inventors: Bardo Koppmann, Kaltenbrunn; Norbert Mitlmeier, Ursensollen, both of (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/355,094

(22) PCT Filed: Jan. 9, 1998

(86) PCT No.: PCT/DE98/00064

§ 371 (c)(1),
(2), (4) Date: Jul. 21, 1999

(87) PCT Pub. No.: WO98/33194

PCT Pub. Date: Jul. 30, 1998

(30) Foreign Application Priority Data

Jan. 22, 1997 (DE) ..... 197 02 130

(51) Int. Cl.[7] ..... H01F 3/00; H01F 7/00
(52) U.S. Cl. ..... 335/279; 335/203; 335/261
(58) Field of Search ..... 335/78–86, 132, 335/154, 203, 249, 261, 271, 279, 281

(56) References Cited

U.S. PATENT DOCUMENTS

| | | | | |
|---|---|---|---|---|
| 2,436,354 A | | 2/1948 | Burke et al. | |
| 2,443,784 A | * | 6/1948 | Bullen et al. | 335/78 |
| 2,491,140 A | * | 12/1949 | Sweger | 335/80 |
| 2,738,450 A | | 3/1956 | Matthews | |
| 2,882,461 A | * | 4/1959 | Glassow | 335/78 |
| 4,083,024 A | | 4/1978 | Rover | |
| 5,375,811 A | * | 12/1994 | Reinicke | 251/129.16 |
| 5,560,549 A | * | 10/1996 | Ricco et al. | 239/533.8 |

FOREIGN PATENT DOCUMENTS

| | | |
|---|---|---|
| DE | 907 085 | 3/1954 |
| DE | 953 366 | 11/1956 |
| DE | 2 122 977 | 11/1972 |
| DE | 34 15 761 | 10/1985 |
| DE | 44 36 832 | 3/1996 |
| EP | 0 118 040 | 9/1984 |

* cited by examiner

*Primary Examiner*—Lincoln Donovan
*Assistant Examiner*—Tuyen Nguyen
(74) *Attorney, Agent, or Firm*—Kenyon & Kenyon

(57) ABSTRACT

An armature for a magnetic system of a switchgear, produced in the form of a one-piece sintered part, whose free design makes it possible to easily optimize the flux and mass and reduce production costs. The armature an H-shaped profile with lateral, plate-shaped pole faces which are interconnected by a central segment that guides the flux above and beneath a through-hole.

6 Claims, 2 Drawing Sheets

SINTERED ARMATURE

FIELD OF THE INVENTION

The present invention relates to an armature for a magnetic system, in particular of a switchgear, with a one-piece design and lateral pole faces.

BACKGROUND INFORMATION

An armature of this type is described in German Patent No. 44 36 832. The armature is designed in the form of a one-piece, magnetically active steel part with an armature plate and a fastening device extending from the latter. It has a bushing for holding a bolt, the bushing being formed by a recess reaching from the bottom of the steel plate into a raised area extending from the latter. The armature is made of a steel block from which the outer contours of the steel plate with the fastening device are milled, as well as, in a further step, a longitudinal opening for creating the bushing. The armature is provided for a magnetic system, in particular a contactor.

The trend toward ever smaller, low-cost solenoid-operated mechanisms, makes it necessary to optimize the geometric dimensions of magnetic systems and reduce the number of parts. To accomplish this, it is advantageous to select the shape of the iron parts so that space can be saved for other elements. The magnetic system armatures designed presently are usually made of steel plates having a uniform thickness. To attach this steel plate to the contact carrier of a contactor, aluminum adapter parts are screwed onto the steel plate in order to reduce mass. If the armature width is to be greatly varied using this technique, the magnetic flux density would enter a state of saturation in partial areas. This produces an elevated magnetic resistance with the known disadvantages in the tensile force variation of the contactor drive.

If this iron saturation is circumvented in partial areas by appropriately adjusting the thickness of the material over the entire part, the result is a larger moving mass, which, in turn, has a negative effect on the drive layout.

To reduce the armature width in only certain areas without increasing flux density it may be possible we could try to improve the arrangement by attaching additional iron parts. However, the armature thickness must be partially increased in this case in order to compensate for the width reduction in the area affected. Retrofitting additional elements, however, creates problems with air gap transitions and the method of connection. Other options, such as milling the part from solid material or producing it by casting, are relatively costly.

SUMMARY

An object of the present invention is to provide an armature that can be produced as economically and simply as possible.

According to the present invention, this object is achieved by producing the armature in the form of a sintered part having an H-shaped profile, with the plate-shaped lateral pole faces being interconnected by a central segment which projects over the thickness of both pole faces. A design of this type provides considerable advantages. It allows the armature to have a simple and economical design, providing high-quality surfaces without any later finishing work and simultaneously producing the bushing for holding a bolt. Because the armature may have any desired shape as a sintered part, the flux and mass can be easily optimized.

Due to its H-shaped design and the ability to guide the flux across the thicker central segment, the armature has a space which can be used for other purposes, such as return springs or guides, in the switchgear where the armature will be installed.

The armature is advantageously adjusted to the magnetic flux by having the pole faces tapering toward their edges.

DETAILED DESCRIPTION

Figure 1:
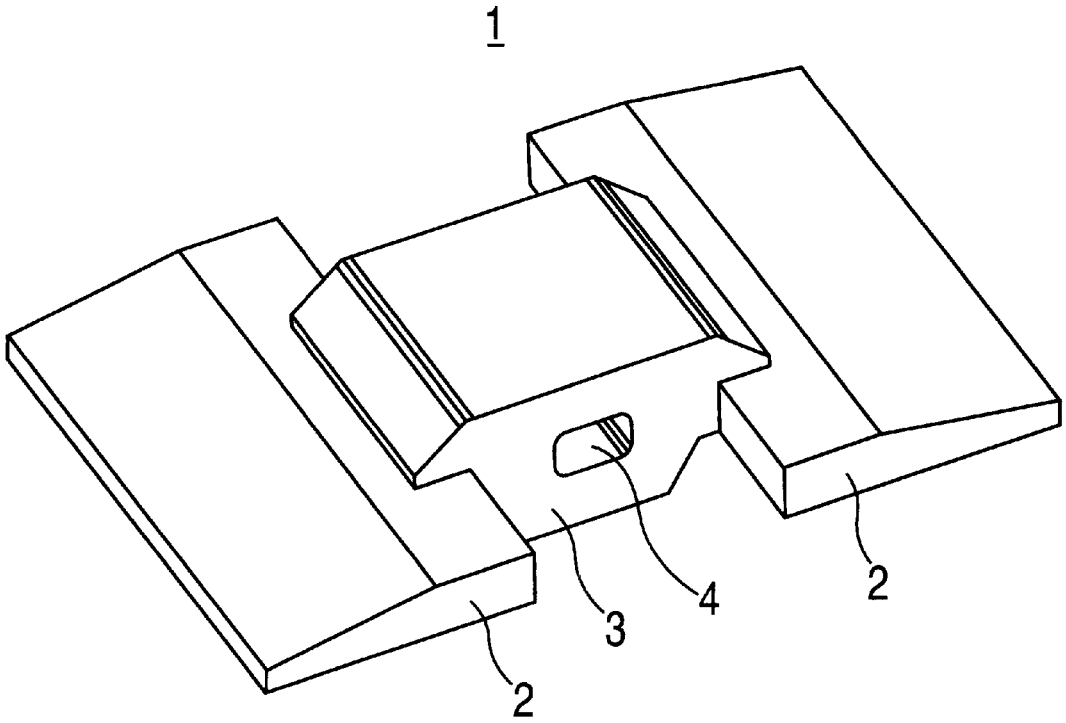
FIG. 1 shows an example embodiment of an armature in accordance with the present invention.

FIG. 1 shows an example embodiment of the present invention.

In particular, FIG. 1 shows an armature 1 for a magnetic system, in particular of a switchgear (such as a contactor), designed in a single piece. It has an H-shaped profile which lateral, plate-shaped pole faces 2 which are interconnected by a central segment 3 projecting over the thickness of both pole faces. Armature 1 is produced in the form of a sintered part.

Figure 2:
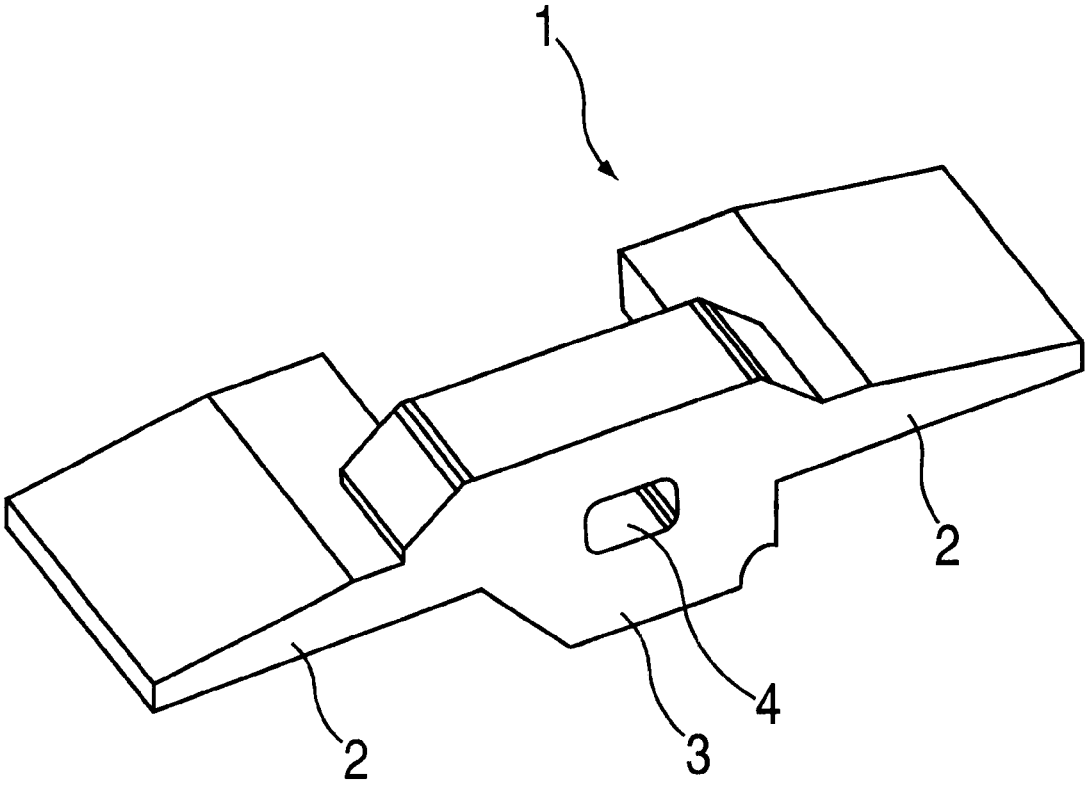
FIG. 2 shows a cross-section of the armature of FIG. 1.

Its pole faces 2 are tapered toward their edges to optimize flux and mass. FIG. 2 shows a cross-sectional view of the armature 1.

In this embodiment according to the present invention, the armature mass is reduced by providing it with a thickness in the pole face region which is adjusted to the cumulative flux. The thickness of the armature in the outer area of the magnetic system is reduced according to the decrease in the magnetic flux. This mass reduction allows the return spring to have a lower restoring force at a given impact resistance of the device where the armature will be installed. The mass reduction consequently has a positive effect on the total force balance in the switchgear, which, in turn, helps decrease the size of the magnetic system and reduce the driving power. The H-shaped profile of the armature, with its lateral recesses, e.g. for return springs or guides, is possible without having to increase the thickness of the armature overall. The magnetic flux can be guided above and beneath through-hole 4 in central segment 3 for holding the bolt.

The ability to freely design the armature in a single piece eliminates the need for additional adapter parts for installing the armature in the contact bridge carrier of a switchgear.

Although the present invention is explained on the basis of the embodiment illustrated in the attached drawing, it should be kept in mind that this is not intended to limit the present invention to the illustrated embodiment, but rather to include all possible variations, modifications, and equivalent arrangements to the extent that they are covered by the content of the patent claims.

What is claimed is:

1. An armature for use in a magnetic system, comprising:

a single piece sintered part having a H-shaped profile and having plate shaped lateral pole faces, the pole faces being bridged together via a central segment of the single piece sintered part, each of the pole faces having an outer edge and being tapered toward the outer edge, a thickest part of each of the pole faces being proximal to the central segment, the outer edge of each of the pole faces being distal to the central segment, the central segment overlapping each of the pole faces at the thickest part of each of the pole faces.

2. The armature according to claim 1, wherein the pole faces are tapered.

3. The armature according to claim 1, wherein the central segment is thicker than the thickest part of each of the pole faces.

4. An armature for use in a magnetic system, comprising:

a single piece sintered part having a H-shaped profile, the sintered part including lateral plates, the lateral plates being lateral pole faces, the lateral plates being bridged together via a central segment of the single piece sintered part, each of the pole faces having an outer edge and being tapered toward the outer edge, a thickest part of each of the pole faces being proximal to the central segment, the outer edge of each of the pole faces being distal to the central segment, the central segment overlapping each of the lateral plates at the thickest part of each of the lateral plates.

5. The armature according to claim 4, wherein the central segment is thicker than the thickest part of each of the lateral plates.

6. An armature for use in a magnetic system of a switchgear, comprising:

a single piece sintered part having a H-shaped profile, the sintered part including lateral plates, the lateral plates being lateral pole faces, the lateral plates being bridged together via a central segment of the single piece sintered part, each of the pole faces having an outer edge and being tapered toward the outer edge, a thickest part of each of the lateral plates being proximal to the central segment, the outer edge of each of the later plates being distal to the central segment, and the central segment being thicker than the thickest part of each of the pole faces.

* * * * *